United States Patent [19]

Love et al.

[11] 4,109,058

[45] Aug. 22, 1978

[54] X-RAY TUBE ANODE WITH ALLOYED SURFACE AND METHOD OF MAKING THE SAME

[75] Inventors: William D. Love, Waukesha; Robert E. Hueschen, Hales Corners, both of Wis.

[73] Assignee: General Electric Company, Schenectady, N.Y.

[21] Appl. No.: 682,509

[22] Filed: May 3, 1976

[51] Int. Cl.[2] ..... B22F 3/00

[52] U.S. Cl. ..... 428/553; 75/208 R; 75/200; 75/212; 75/211; 313/330; 313/60

[58] Field of Search ..... 29/182.2, 182.3; 75/208, 211, 200, 212; 313/330, 60

[56] References Cited

U.S. PATENT DOCUMENTS

| | | | |
|---|---|---|---|
| 3,136,907 | 6/1964 | Kieffer et al. | 313/330 |
| 3,375,109 | 3/1966 | Peters | 75/176 |
| 3,900,751 | 8/1975 | Holland et al. | 313/330 |
| 3,936,689 | 2/1976 | Birjukova et al. | 313/330 |

FOREIGN PATENT DOCUMENTS

| | | | |
|---|---|---|---|
| 1,383,557 | 2/1975 | United Kingdom | 313/330 |

*Primary Examiner*—Brooks H. Hunt
*Attorney, Agent, or Firm*—Ralph G. Hohenfeldt

[57] ABSTRACT

An x-ray tube anode has a body or substrate comprised of molybdenum or an alloy thereof and a surface layer on which an electron beam impinges to generate x-rays, comprising an alloy of tungsten, rhenium and molybdenum. A method of making the anode is also disclosed.

13 Claims, 2 Drawing Figures

X-RAY TUBE ANODE WITH ALLOYED SURFACE AND METHOD OF MAKING THE SAME

BACKGROUND OF THE INVENTION

This invention relates to improvements in the composition and method of making an anode for an X-ray tube.

A well known problem in prior art X-ray tubes is that the surface on which the electron beam impinges develops fractures and roughens after many thermal cycles. Surface fractures have a propensity to propogate and sometimes advance until breakage of the target occurs, especially in high speed rotary anode x-ray tubes. Surface fractures allow the electron beam to penetrate such that radiation at the focal spot is intercepted and absorbed by surface layer material. This is manifested in an x-radiation output decrease.

For a long time, anodes or targets as they are sometimes called, were made solely of sintered tungsten of the best purity obtainable. Within about the last decade, laminated anodes were developed comprised of a body of refractory metal such as pure tungsten or pure molybdenum or alloys of these metals and a surface coating for electron impingement comprised of sintered mixtures of tungsten and rhenium powders. The tungsten and rhenium surface layer mixtures have better ductility and lower ductile-to-brittle transition temperatures compared with pure tungsten and exhibited less fracturing after thousands of x-ray exposures.

Tungsten and rhenium surface layer compositions also have reasonably good thermal properties such as high thermal conductivity and low vapor pressure. Use of tungsten-rhenium surface layers does not, however, attain optimum metallurgical properties and fracturing, although reduced in comparison with tungsten or molybdenum alone, is still observed in x-ray tubes which are subjected to the high thermal loading and duty cycles which the most advanced x-ray procedures impose.

One of the residual problems is that the density of the surface layer materials is not close enough to the theoretical maximum density. The inability to approach maximum density means that there are a substantial number of microscopic voids in the surface material. Thermal stresses, due to the intense energy at the focal spot of the electron beam, cause fracture initiation from the surface to the voids located just underneath the surface. Ultimately, the small fractures enlarge and the tube must be removed from service.

Those who are skilled in the metallurgy of x-ray tube anodes appreciate that increasing the density of the anode surface material and reducing the number and size of the voids causes a reduction in fracture initiating sites. It is also understood that if the surface layer material is close to maximum or theoretical density, ductility of the material will be improved since there will be a smaller concentration of voids available to stop dislocation motion. Dislocations must move through the surface layer alloy to relieve stress and prevent fractures. If a moving dislocation encounters a void, it is stopped or arrested and is, therefore, unable to provide additional stress relief. The material will then fracture.

It is known that tungsten can be made more ductile even at room temperature by alloying it with inherently more ductile metals such as rhenium. As indicated above, rhenium has been used for this purpose in x-ray anode surface layers and, to a limited extent, in their bodies or substrates. Rhenium is commonly used as an alloying metal with tungsten but it has the disadvantage of being a very expensive and relatively scarce material. Iridium, rhodium, tantalum, osmium, platinum and molybdenum are further examples of metals which are known to improve ductility when alloyed with tungsten. However, the use of many of these metals in surface layers of high energy x-ray tubes has been avoided because they exhibit high vapor pressures at high temperatures compared with tungsten and are evaporated at peak operating temperatures of the anodes. Some of these metals also have the disadvantages of being relatively expensive and scarce. The evaporated metal deposits on the inside of the x-ray tube envelope and nullifies the insulating properties of the tube so it is less stable at high voltages.

By way of illustration, molybdenum has some properties which make it desirable as an alloy addition to anode surface layers. It has good ductility and susceptibility for being treated metallurgically like tungsten but molybdenum melts at 2610° C compared with tungsten which melts at 3410° C and rhenium which melts at 3180° C. Molybdenum also has an undesirably high vapor pressure, especially at peak anode temperatures existing in the highest power x-ray tubes required today. For example, molybdenum has a vapor pressure of $10^{-7}$ Torr at only 1700° C whereas tungsten has this same vapor pressure at 2260° C and rhenium at 2100° C. Other prospective alloying materials mentioned above and still others have lower melting points and higher vapor pressures than tungsten and they have, heretofore, been considered unqualified as surface layer alloy additions. Of course, as is well known, anodes made solely of molybdenum or molybdenum and tungsten are regularly used in x-ray tubes where abundant soft or low energy radiation is desired such as in tubes used for mammography. These high molybdenum content alloys are, however, restricted to operation at power levels significantly below those required for tubes intended for general diagnostic procedures. As stated earlier, anodes comprised of a molybdenum body with a tungsten-rhenium surface layer are also in widespread use in high energy x-ray tubes but care is taken that none of the molybdenum is permitted near the front surface of the anode in the region of high temperature prevailing at the beam focal spot.

Recently, anodes have been developed which use a graded surface layer. The first outer surface layer on which the electron beam impinges is a tungsten-rhenium alloy. Below the first layer is a second layer which comprises tungsten-rhenium and molybdenum. The content of molybdenum in the second layer diminishes in the direction of the first layer and, conversely, the content of rhenium diminishes in the direction of the substrate which is essentially molybdenum or a molybdenum-tungsten alloy. Thus, no molybdenum from the substrate or the surface layer is exposed to direct electron impact.

SUMMARY OF THE INVENTION

A primary object of the present invention is to provide an x-ray tube anode with improved resistance to surface layer degradation when it is subjected to multiple high energy thermal cycles.

A further object is to provide an anode having a surface layer comprised of a ternary alloy or tungsten, rhenium and molybdenum characterized by the alloy being closer than heretofore obtainable to its theoretical maximum density, by ductility improvement from use of molybdenum and by a reduced vapor pressure below that which is expected of unalloyed molybdenum.

Yet another object is to disclose a method for alloying molybdenum, rhenium and tungsten through use of perrhenic acid for making surface layer materials that are used in x-ray tube anodes.

Further advantages and other more specific objects of the invention will become apparent in the more detailed description of the surface alloy compositions and method of making them which will now be set forth.

DESCRIPTION OF A PREFERRED EMBODIMENT

Figure 1:
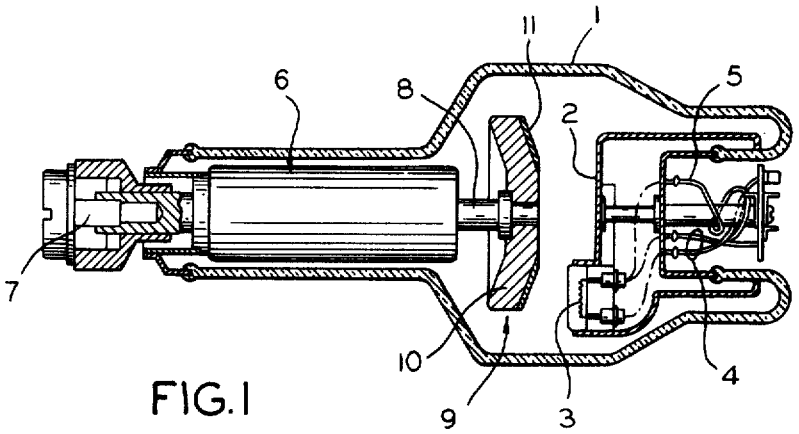
FIG. 1 is a side elevation of a typical x-ray tube in which the new anode may be used, the envelope of the tube being shown in section.

The illustrative rotating anode x-ray tube in FIG. 1 comprises a glass envelope 1 having a cathode structure 2 mounted at one end of the tube. The emitter from which an electron beam is emitted is marked 3. The emitter, which is usually a thermionic filament, is supplied with current for heating it through leads marked 4. Another lead 5 is connected to the emitter and is usually at a high negative potential with respect to ground. Mounted at the end of the tube opposite of the emitter is a rotor structure 6 which is in electric continuity with a stem 7 by which a high positive potential may be applied to the anode structure. A stem 8 at the other end of the rotor is rotatable and has the x-ray producing target or anode 9 mounted on it. Anode 9 comprises a refractory metal body 10 and an annular beveled surface having a surface layer or coating 11 on which the electron beam impinges to produce x-rays.

Figure 2:
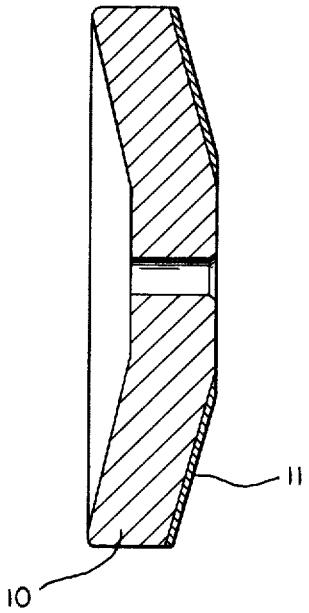
FIG. 2 is a cross section of a disc illustrative of a target or anode used in a rotating anode x-ray tube.

FIG. 2 shows one type of anode for a rotary anode x-ray tube in connection with which the new structure and method may be used. The anode body 10 may be made of substantially pure molybdenum or an alloy of molybdenum and tungsten and either may have small amounts of other alloying additions to achieve particular metallurgical properties that may be desired. Many of the known refractory metal substrates may be used.

The surface layer 11 on which the x-ray beam impinges to produce x-radiation is, in accordance with the invention, a ternary alloy of tungsten, rhenium and molybdenum. The thickness of surface layer 11 should preferably be at least 0.008 inch (0.2mm). Thicknesses of under 0.05 inch (1.27mm) have been found satisfactory. Generally, thicknesses in excess of 0.090 inch (2.286mm) should be avoided since greater thickness results in excessive use of expensive and scarce rhenium.

An important feature of the invention is that the surface layer 11 actually contains a small amount of molybdenum which is exposed directly to the electron beam and, hence, involved in production of x-radiation. Thus, molybdenum is present at the surface to provide beneficial ductilizing effects and to increase the density of the tungsten, rhenium and molybdenum alloy. Molybdenum is also present to provide high temperature solid-solution strengthening of the surface layer as well as low temperature ductilizing effects.

The anodes are fabricated in a manner that is generally known, that is, by sintering the powdered metal body 10 along with the powdered metal surface layer 11 which has been pressed onto the body. However, the surface layer is produced in a special way, in accordance with the invention, to enable forming what is believed to be a true and very homogeneous alloy rather than a mixture of powders of molybdenum and the other surface layer constituents so that the desirable properties mentioned above are achieved.

Two different ways for preparing the surface layer materials will be given. Method No. 1 is to add perrhenic acid to the molybdenum powder where enough acid is used to assure a percentage of rhenium by weight that is sufficient to cover each molybdenum particle completely. The molybdenum-rhenium is then mixed or thoroughly blended with tungsten powder which is the major constitutent. Additional perrhenic acid is then added to the mixture to obtain the desired tungsten, rhenium and molybdenum percentages. The slurry is then mixed until uniform wetting of all of the particles by perrhenic acid is assured. After neutralizing with ammonium hydroxide, and drying the powder mixture by heating it in air to about 100° C, the perrhenic acid is then reduced to basic rhenium which is in intimate contact with the other refractory metal powders, by heating the powder mixture to a temperature in the range from 800° C to 1200° C in a hydrogen atmosphere. This powder mixture may then be employed in forming the surface of a target or anode. The composite anode is then compacted under a pressure of about 30 tons per square inch (about 4200 kilograms per square centimeter) to form a self-supporting mass. The anode is then sintered in a dry hydrogen atmosphere, preferably, or in vacuum at a temperature of 2300° C to 2500° C to obtain the homogeneous surface layer alloy and to densify the entire anode structure. The anode target is subsequently hot forged at temperature in a range of 1300° C to 1700° C to achieve further densification. As will be demonstrated below, the molybdenum provides a significant benefit in the forging densification process. By mixing perrhenic acid and molybdenum before the mixture is added to the tungsten powder, there is an increased probability that all of the molybdenum powder will be completely coated with rhenium in case there should happen to be preferential coating of the tungsten by the perrhenic acid.

Method No. 2, which is simpler but involves the same basic steps as method No. 1, involves blending the tungsten and molybdenum powders first and then adding the requisite amount of perrhenic acid for the percentage of rhenium that is desired. The drying, sintering and forging steps may be the same as in method No. 1.

In any case, sufficient perrhenic acid is used to provide the weight equivalent of rhenium which will result in the desired final percentage of rhenium in the tungsten-molybdenum-rhenium surface layer alloy. The necessary amount of perrhenic acid may be calculated easily by those versed in the chemical and metallurgical arts. The fineness of the molybdenum and tungsten powders may be substantially the same as has been used heretofore in processes for making anodes with refractory metals. More information on the perrhenic acid method employed herein is obtainable from U.S. Pat. Nos. 3,375,109 and 3,503,720.

Molybdenum in small amounts is the new element added in a particular way to presently widely used tungsten-rhenium anode surface layers. One of the most popular currently used targets is one having a substrate or body of tungsten or tungsten-molybdenum alloy or essentially pure molybdenum and a surface layer comprised of 90% tungsten and 10% rhenium. Accordingly, comparative tests have been made with x-ray tubes using prior art anodes comprised of 90% tungsten and 10% rhenium and new anodes made in accordance with the above methods having 89% tungsten, 10% rhenium and 1% molybdenum. Thus, the rhenium content of the new targets remains the same as the prior art anodes but one percent of tungsten was replaced with an equal amount of rhenium. The purpose was to try to show the effect of molybdenum.

Several prior art anodes having 90% tungsten and 10% rhenium alloy surface layers were obtained in ordinary commercial channels and selected at random. They were built into x-ray tubes. Anodes made in accordance with method No. 1 above and others, made in accordance with method No. 2 above were built into x-ray tubes. All of the tubes were subjected to the same loading during the tests. The cathode to anode voltage was 75 peak kilovolts, the electron beam current was 250 milliamperes, and of 1.5 seconds duration were made at a rate of 2 exposures per minute with an anode rotational speed of about 3600 rpm. The tubes were tested in a range up to 15,000 exposures. The average decline in x-ray output for the prior art anodes was found to be 0.78% per 1,000 exposures and for the new surface layer alloy anodes the average was 0.38% per 1,000 exposures, that is, approximately half that of prior art anodes. In any event, the new 89% tungsten, 10% rhenium and 1% molybdenum surface layer alloy anodes made by either method No. 1 or No. 2 appear to be superior with regard to surface stability throughout anode life as measured by sustained x-ray photon production. In the above tests and in other tests with even higher tube loadings, there was no evidence of any molybdenum being evaporated or deposited on the interior of the tube envelope.

Surface layer density measurements were also made on prior art anodes using 90% tungsten and 10% rhenium in the surface layer and on the new anodes having 89% tungsten, 10% rhenium and 1% molybdenum. The prior art anodes had average values of 91.8% of theoretical density and the new anodes averaged 96.2% of theoretical density. The theoretical density of the 10% rhenium and 89% tungsten alloy, and the 10% rhenium and 1% molybdenum alloy was taken as 19.46 and 19.38 grams per cubic centimeter, respectively. Data taken thus far indicates, on an average, a significant 4% increase in density for the ternary alloy. The density increase for the new alloy allows an inference that there are fewer voids in the alloy and this is confirmed by reduced surface fracturing that was observed and manifested by reduced radiation output decline. This also allowed the logical inference that the molybdenum had contributed substantially to increasing the ductility as well as the density of the surface layer.

A variety of anodes having ternary tungsten-rhenium-molybdenum alloy surface layers of other compositions were made and tested with good results. In the light of present knowledge, it may be stated that a range of 0.5% to 10% of molybdenum may be used with beneficial results in the surface layer. The combination of molybdenum and rhenium, that is, the non-tungsten portion of the surface layer, should be within the range of 3% to 15% but preferably between 5% and 10%. A good overall range is determined to be 88% to 96% tungsten, 1% to 5% rhenium and 1% to 5% molybdenum.

The true scope of the present invention should be determined by interpretation of the claims which follow.

We claim:

1. An anode for a rotating anode x-ray tube which anode has an exposed area on which an electron beam may impinge to cause production of x-radiation, said anode comprising:

a body comprised of refractory metal, and a surface layer alloy on said body constituting said exposed area for said electron beam to impinge directly thereon, said layer composed of a ternary alloy wherein fine tungsten and molybdenum particles are both completely coated with rhenium to provide a true and homogeneous alloy.

2. An anode as in claim 1 wherein said body is substantially pure molybdenum.

3. An anode as in claim 1 wherein said body comprises a metal selected from the group consisting of tungsten, molybdenum and alloys of tungsten and molybdenum.

4. An anode as in claim 1 wherein said surface layer alloy comprises 0.5% to 10% molybdenum, 1% to 10% rhenium, with the balance being tungsten at least in the amount of 85%.

5. An anode as in claim 1 wherein the percent of molybdenum and rhenium combined is in the range of 3% to 15% and the balance being tungsten.

6. An anode as in claim 1 wherein the amount of molybdenum in said surface layer alloy is in the range of 0.5% to 10% by weight.

7. An anode for a rotating anode x-ray tube which has a sufficiently high power rating to enable use of said tube for general x-ray diagnostic purposes, said anode having an exposed area on which an electron beam may impinge to cause production of x-radiation, said anode comprising:

a body comprised of refractory material, a surface layer on said body constituting said exposed area for said electron beam to impinge directly thereon, said surface layer being composed of a ternary alloy of tungsten, rhenium and molybdenum, said ternary alloy being formed in a process including completely coating fine tungsten and molybdenum particles with rhenium derived from a solution containing a rhenium compound, said anode being made by the method comprising:

mixing powdered molybdenum and perrhenic acid where the acid is in sufficient amount to provide enough rhenium for completely coating the particles of said powder with rhenium when said acid is reduced to rhenium, adding to said mixture powdered tungsten and then adding more perrhenic acid in an amount to provide sufficient rhenium for the amount of rhenium that is desired in the final mixture so that said mixture will have the amounts of tungsten, rhenium and molybdenum desired in an electron impingement surface layer of said anode, after neutralizing the perrhenic acid, applying sufficient heat to dry the powder mixture, then reducing the rhenium to pure metal which is in intimate contact with the other refractory metal powders, by heating said powder mixture to a temperature in the range from 800° C to 1200° C in a hydrogen atmosphere, pressing said dried mixture as a surface layer with additional powdered refractory metal constituting the body of said anode, subjecting the composite of said surface layer and said body to intense pressure, heating said composite to a temperature in the range from 2300° C to 2500° C to obtain a solid solution alloy in the surface layer and to densify the entire sintered body, and hot forging said composite at temperatures in the range of 1300° C to 1700° C to achieve further densification of said composite.

8. An anode for a rotating anode x-ray tube which has a sufficiently high power rating to enable use of said tube for general x-ray diagnostic purposes, said anode having an exposed area on which an electron beam may impinge to cause production of x-radiation, said anode comprising:

a body comprised of refractory material, a surface layer on said body constituting said exposed area for said electron beam to impinge directly thereon, said surface layer being composed of a ternary alloy of tungsten, rhenium and molybdenum, said ternary alloy being formed in a process including completely coating fine tungsten and molybdenum particles with rhenium derived from a solution containing a rhenium compound, said anode being made by the method comprising:

mixing powdered tungsten and powdered molybdenum and then adding perrhenic acid where the acid is in sufficient amount to provide enough rhenium for completely coating the particles of said powders, respectively, with rhenium when said acid is reduced to rhenium, after neutralizing the perrhenic acid, applying sufficient heat to dry the powder mixture, then reducing the rhenium to pure metal which is in intimate contact with the other refractory metal powders, by heating said powder mixture to a temperature in the range from 800° C to 1200° C in a hydrogen atmosphere, pressing said dried mixture as a surface layer with additional powdered refractory metal constituting the body of said anode, subjecting the composite of said surface layer and said body to intense pressure, heating said composite to a temperature in the range from 2300° C to 2500° C to obtain a solid solution alloy in the surface layer and to densify the entire sintered body, and hot forging said composite at temperatures in the range of 1300° C to 1700° C to achieve further densification of said composite.

9. An anode for a rotating anode x-ray tube which has a sufficiently high power rating to enable use of said tube for general x-ray diagnostic purposes, said anode having an exposed area on which an electron beam may impinge to cause production of x-radiation, said anode comprising:

a body comprised of refractory material, a surface layer on said body constituting said exposed area for said electron beam to impinge directly thereon, said surface layer being composed of a ternary alloy of tungsten, rhenium and molybdenum, said ternary alloy being formed in a process including completely coating fine tungsten and molybdenum particles with rhenium derived from a solution containing a rhenium compound, pressing a layer of said coated particles to a layer of metal particles, which comprise said body, subjecting the composite of said layer and said body to high temperature to convert said layer to a solid solution alloy, and hot forging said composite to densify it.

10. An anode as in claim 9 wherein said body is substantially pure molybdenum.

11. An anode as in claim 9 wherein said body comprises a metal selected from the group consisting of tungsten, molybdenum and alloys of tungsten and molybdenum.

12. An anode as in claim 9 wherein said surface layer alloy comprises 0.5% to 10% molybdenum, 1% to 10% rhenium, with the balance being tungsten at least in the amount of 85%.

13. An anode as in claim 9 wherein the percent of molybdenum and rhenium combined is in the range of 3% to 15% and the balance being tungsten.

* * * * *